United States Patent [19]

Homuth

[11] 4,207,800

[45] Jun. 17, 1980

[54] SINGLE DIRECTIONAL SEALING PISTON RING

[76] Inventor: Kenneth C. Homuth, 9149 Meadowview Rd., Bloomington, Minn. 55420

[21] Appl. No.: 957,013

[22] Filed: Nov. 2, 1978

[51] Int. Cl.[2] ..... F15B 15/22

[52] U.S. Cl. ..... 91/26; 91/409

[58] Field of Search ..... 91/408, 409, 25, 26; 92/162

[56] References Cited

U.S. PATENT DOCUMENTS

| | | | |
|---|---|---|---|
| 3,296,942 | 1/1967 | Nelson | 91/409 |
| 3,396,976 | 8/1968 | Reinhoudt et al. | 92/162 R |
| 3,592,106 | 7/1971 | Baughman | 91/409 |
| 3,626,812 | 12/1971 | Trick | 91/408 |
| 3,776,100 | 12/1973 | Yeh | 91/409 |
| 3,802,319 | 4/1974 | Bridwell | 91/409 |

*Primary Examiner*—Paul E. Maslousky

[57] ABSTRACT

A piston ring for use in hydraulic cylinder cushions wherein advantage is made of the typical imperfect seal characteristics of a conventional metallic piston ring to effect a cushion exhaust fluid metering action near the piston stroke end; the piston ring then uniquely allowing major fluid bypass in the reverse stroke or input fluid pressure direction for instant, full reverse stroke piston velocity response wherein the invention includes a piston ring having a notched pattern in one ring edge surface, which surface is adjacent a piston ring groove side wall, thereby eliminating the prior art need for added secondary flow circuits to accomplish the same instant out of cushion full piston velocity result.

14 Claims, 5 Drawing Figures

SINGLE DIRECTIONAL SEALING PISTON RING

BACKGROUND OF THE INVENTION

This invention relates to hydraulic cylinder porting and piston configurations and especially to a unique special purpose piston ring which has no seal characteristics in one ring groove contact face thereby allowing virtual free fluid bypass in one piston direction proximate one end of the cylinder stroke.

In the prior art, the conventional approach to driving a hydraulic cylinder is by means of pressurized oil or hydraulic fluid which is admitted into the cylinder to exert its pressure against one piston face and thereby force the piston away from the pressurized oil input. When the piston has reached the end of its stroke, pressurized oil is admitted into its opposite cylinder end to act against the opposite piston face to drive the piston back toward the beginning cylinder end, with the first oil entry point or orifice serving as an oil exhaust during this piston stroke. Thus, in one case pressurized oil is admitted via an orifice in one end of the cylinder with the orifice at the other end exhausting previously admitted oil, and in the reverse piston direction the pressurized oil is admitted into the second orifice with the first orifice serving as an oil exhaust orifice. External valving accomplishes the directional flow control required to admit and relieve oil from the respective cylinder ends. The valves which therefore direct piston travel are typically operated by manual or automatic control to achieve powered motion of an apparatus connected to the piston rod. The cylinder oil orifices or ports are constructed either in the end faces of the cylinder or near the end faces, perpendicular to and through the cylinder bore wall.

The latter construction mentioned here offers an opportunity for means to a hydraulic cushioning effect in that the piston may be allowed to slide over its exhausting oil orifice as the piston nears the end of its stroke, thereby cutting off or trapping an amount of oil between the cylinder end wall and the driven face of the piston, and thereby greatly restricting the escape of the trapped oil being exhausted and preventing or greatly reducing the severity of the piston "bottoming" impact which can be damaging to both the cylinder and the machine being actuated by the piston rod. It has been customary in the prior art to use a metallic ring installed in a circumferential groove near either or both piston leading edges or faces to provide a more precise orifice closing medium than the piston surface itself. The ring therefore performs as an exhaust flow metering device in the orifice closing, covering or cushioning part of the cylinder stroke. The present invention provides a means for substantial performance improvement of the ring by offsetting the conventional ring's severe flow restriction, which causes retardation of cylinder reverse stroke response or "out of cushion" piston velocity. The invention concerns a metallic or rigid cross-section non-metallic hydraulic piston ring with conventional limited seal characteristics in one piston direction but which uniquely allows relative free fluid flow by-pass in the opposite direction.

In this type cushion, advantage is taken of the sectional strength and cross-section rigidity of the ring:

1. To resist high fluid pressure extrusion of the ring between adjacent high clearanced sliding members and into fluid exhaust orifices bridged by a portion of its circumference, as indicated above.

2. To preclude the perfect conformity seal characteristics of low durometer of soft seals and which results in a limited but positive circumferential bypass of fluid between its contact surfaces and those of its companion piston and cylinder bore.

Because of this characteristic fluid by-pass, leakage or "weepage", the ring has been used as an exhaust flow metering device in hydraulic cylinder cushions of the sidewall orifice type referred to above and discussed more fully below. While the amount of by-pass will vary with specific ring designs, surrounding surface contact and finishes, fluid viscosity and the amount of pressure differential present, the by-pass is generally adequate for the cushion purposes here described, as the piston and its leading edge ring progressively covers and bypasses the fluid exhausting orifice near the terminal end of the cylinder piston stroke. The volume of fluid so cut off or trapped is dependent on individual design requirements and is determined by the bore diameter of the cylinder and distance the orifice is spaced from the terminal position of the piston. In any regard, the combination of the piston momentum and the orifice closing process results in substantial increase of the now trapped volume pressure, providing a desired time-pressure resistance to the driven face of the piston thereby decellerating piston velocity and dampening otherwise damaging cylinder stroke end impact, as exhaust fluid being expelled by the leading face of the piston is greatly restricted in its escape. While this type of cushioning is quite common, its fluid flow restriction also greatly limits the reverse cylinder stroke response and stroke velocity until the piston and particularly the said ring have moved clear of the orifice which has been externally valved to supply input fluid flow for the opposite direction stroke. In many cases, this "out of cushion" time delay is objectionable, and in some cases a by-passing secondary "starter" circuit is added to offset it. The purpose of the invention is to eliminate the need for such secondary circuits or to improve cylinder performance where the secondary circuit need may be marginal or cost or space limited. The invention is an economical alternative by use of a piston ring that essentially seals (restricts) in one direction only, in effect creating its own secondary circuit within the piston itself, in many cases, by mere substitution of the inventive ring for a conventional ring. In addition, the typical secondary circuit mentioned is essentially a check valve which not only adds to the dollar cost of the assembly, it adds to overall assembly complexity, requires additional space (which can be critical), is an additional service consideration and presents an additional potential fluid contamination trap, all of which are avoided by the present invention.

Put another way, the ring provides the means for a less expensive, simpler, cleaner, more compact, more basic overall cylinder product, with far greater application flexibility in standard piston forms.

Typical piston rings used in hydraulic cylinders may be installed in piston grooves with either vertical face nearest the fluid pressure source since little or no difference can be detected in the amount of fluid bypassed from either face. This has an advantage in that a ring cannot be installed "backwards". This "advantage", however, has no relevance here since the purpose is to create a maximum fluid by-pass difference between ring faces that will permit maximum free fluid flow from its seal opposite vertical face, thereby greatly reducing time delay in reverse stroke response from the terminal piston positions as explained above. In most cases, applications of rigid piston rings in hydraulic cylinder pistons involve several rings in spaced grooves in the piston circumferential surface, the purpose being to offset individual ring leakage by use of multiples and thereby accomplish an acceptable total seal between the cylinder bore and the mating piston surface. The purpose of this invention, however, is to utilize the bypassing characteristics of a single ring, and to use it as a one-directional sealing, flow metering device for cylinder end cushioning purposes while relying on a "bi-directional" inboard seal ring, either conventional metallic or elastomeric, as the primary piston-bore seal in the overall cylinder stroke, with the combination creating a check valve effect. The invention provides an improvement in the subject ring in that it essentially self-cancels itself in one fluid flow direction while retaining its characteristic "seal" capabilities in the opposite direction.

SUMMARY OF THE INVENTION

The invention concerns formation of an interrupted, notched or serrated surface on the circumferential face of one side of the piston ring, such interruption being of sufficient total cross sectional area not only to prevent seal with the adjacent ring groove wall, but also to virtually permit free fluid flow to the piston dash-pot area beyond and greatly in excess of the ring's opposite face seal characteristics. It might be obvious that the same effect could be realized by machine-rolling an interrupted configuration into the dash-pot side ring groove wall circumference or by adding an independent interrupted face ring, or by cross drill venting the ring groove to the dash-pot area —but these represent more cost than generating the desired effect in the piston ring itself. Perhaps as important, by merely installing the invention ring in an otherwise "standard" piston ring groove, the combination assumes the cushion-fast reverse stroke or fast out of cushion response functions that might have otherwise required major special components.

BRIEF DESCRIPTION OF THE DRAWING

A preferred embodiment of the present invention is disclosed herein, and with reference to the drawing, in which.

DESCRIPTION OF THE PREFERRED EMBODIMENT

Figure 1:
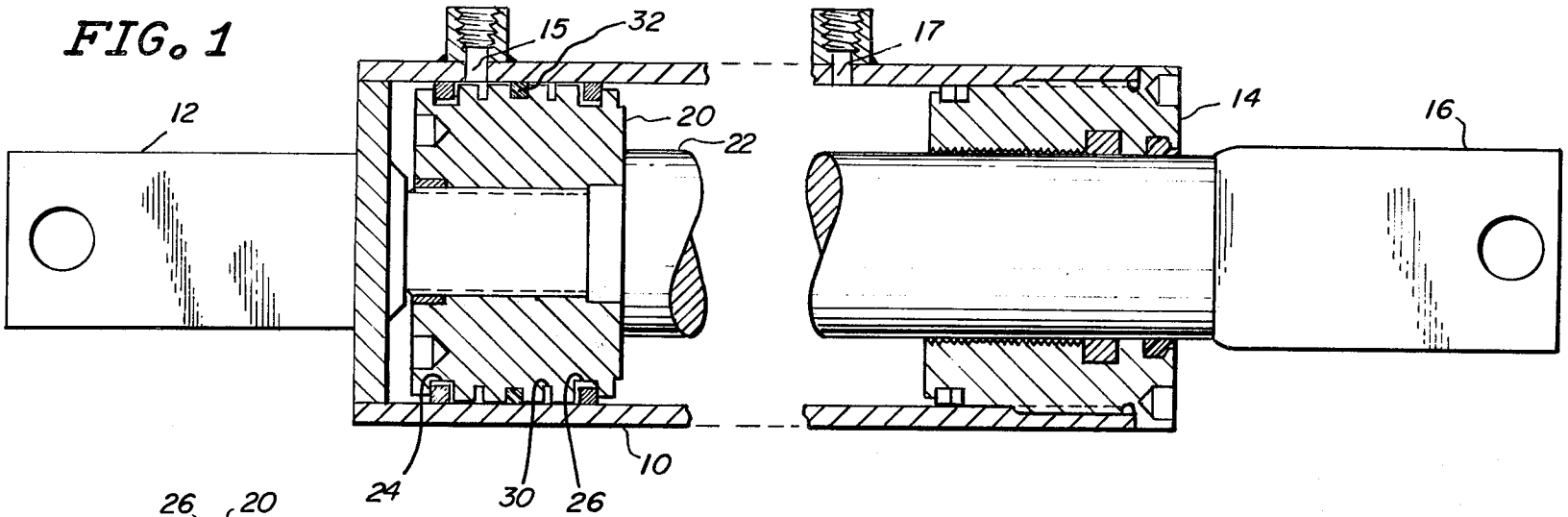
FIG. 1 is a side view in partial cross-section of a hydraulic piston and cylinder.

The following concerns means by which piston "blocked" but inputting orifice flow or "out of cushion" return stroke fluid transports itself through the piston ring groove and via the inventive ring surface to the piston dash-pot area. Means for conducting fluid flow across the piston surface from the blocked orifice to the ring groove is not part of this invention but will be mentioned below, since it is related.

Unlike elastomeric type piston seal rings, which seal on three surfaces, one of which is dynamic or a moving surface with the other two static, the rigid cross-section piston ring types here referred to, seal only on two surfaces, one of which is dynamic and the other is static, the static surface being the piston ring groove side wall opposite the pressure exposed ring side. The elastomeric piston ring is "pre-loaded", to insure initial seal, by cross-section squeeze between its dynamic sealing surface and its cross-section opposite side static sealing surface thereby blocking any possible fluid flow through its housing groove. The rigid cross-section type affects its necessary preload by a designed radial spring action to accomplish and maintain outer diameter (O.D.) circumferential contact with the cylinder bore. The spring action is made possible by a cross cut or fracture of the ring at some point on its circumference which allows an outward diametric expansion of the ring, and the ring therefore assumes a free diameter larger than its intended cylinder bore and must be compressed across its diameter to enter said bore. The ring is therefore not an unbroken circle after fracture though certain of these have varying types of overlap end joints to minimize joint leakage. The lap jointed type is recommended for the cushion purposes described here and for application of the inventive ring surface, since its leakage rate is more acceptable in the single ring intended use described.

The point of this discussion is that since the ring uses outward radial spring action to insure O.D. contact with the bore, and since its rigid cross-section is not deformable under hydraulic pressure, no ring contact is made between the ring inner diameter (I.D.) and the ring groove bottom surface. A substantial circumferential void therefore exists between the ring I.D. and the ring groove bottom, since the groove is also typically considerably deeper than the vertical cross-section of the ring. The circumferential void explained above and the "free float" or typical lateral clearance between the ring vertical faces and its housing or piston ring groove walls provide the flow capacity to flow join the piston blocked cylinder side wall orifice to the dash-pot side of the piston, when the cylinder is valved for its "out of cushion" and return stroke. As a result of downstream pressure drop, the ring is moved away from its inner groove wall by the amount of ring-groove lateral clearance, allowing the pressurized input fluid to pass into the ring groove and under the ring, with the inventive ring face surface completing or providing the final fluid flow connection to the piston dash-pot area, with minimum fluid restriction and out of cushion time delay and without resort to secondary circuit or other special components. This feature will improve performance of all existing cushion designs of this type using conventional rings without the said ring interrupted face surface.

It would be obvious that the return stroke fluid flow into the subject ring groove, under the ring and through the inventive ring interrupted face surface and then into the primary piston dash-pot area, is dependent on or is a direct result of fluid escapement from the inputting but largely piston-blocked orifice which can be some distance inboard along the piston surface from the subject ring. This is dependent on the overlapped distance, or the distance the ring has bypassed the orifice, per its cushion-time requirements and local piston-orifice clearance. This problem is effectively dealt with in my U.S. Pat. No. 4,086,844, issued May 2, 1978 (Hydraulic Cylinder Utilizing Corrugated Running Surfaces) and more particularly in my U.S. Patent Application Ser. No. 893,284, filed Apr. 8, 1978 (Hydraulic Cylinder with Improved Dash-Pot and Porting), which concerns means to convert local piston-blocked orifice-fluid flow to circumferential cross flow through the piston-bore clearance, over the piston circumferential surface, either directly to the piston dash-pot area or to the subject flow metering cushion ring if said ring is used, not around it or past it, which is the concern of the present invention ring surface. It is a premise of the present invention that regardless of the local piston-blocked orifice restriction no seal is made at this junction and whatever input flow is greater than the leakage rate of said conventional lap jointed piston ring. The ring itself, therefore, is the major restriction-deterrent to adequate out of cushion piston velocity response regardless of available flow, in which the present invention ring surface provides an effective ring performance improvement through means to self-cancellation, in its seal opposite face.

The preceding discussion describes the purpose, function and advantage of the present invention. The succeeding discussion describes its limits and design guidelines. Although no claim is made that the inventive ring surface allows unrestricted flow to the piston dash-pot on stroke reversal, it is an improvement over the alternative, which in a typical secondary circuit provides a considerable restriction and is generally of much smaller cross-sectional area, and fluid volume capacity, for limited space reasons, than the primary fluid feed lines to the cylinder from the system valve. These lines are sized for minimum fluid friction at the gallons per minute (G.P.M.) required for desired overall cylinder stroke velocity. The secondary circuit approximates fluid delivery volume of the feed lines through increased fluid flow velocity, as does the inventive ring "flow through" surface. Increased fluid velocity generates heat in either case, but is more effectively dissipated by the present invention because of its far greater effective orifice circumference which is that of the cylinder bore diameter, which is roughly ten times the circumference of any likely secondary orifice. For example, as a rule, which obviously has exceptions, the primary feed lines to a hydraulic cylinder are roughly 1/10th the diameter of the cylinder bore with any added secondary cushion circuits of ½ the main line diameter or ¼ the cross-sectional flow area. Even if the secondary flow-through diameter were equal to the main line, the cylinder bore diameter of the ring has ten times the circumference. This has relevance here, not only in greater heat dissipation but in that the relatively great circumferential length of the ring will accommodate a substantial circumferential notch pattern in the ring face, easily equalling or exceeding the fluid flow capacity of any likely used typical secondary circuit. The flow through volume of the ring can, by design, easily exceed the purposes described here. In the "pure" side wall orifice cushion concept using no typical secondary bypassing circuits but using the inventive ring surface, the limiting piston blocked orifice flow factor is now not the ring, but the mean circumferential clearance between the piston bearing surface and the cylinder bore, which circumferential clearance actually transports the flow from the blocked orifice to the ring and its housing groove. While such clearance cross-sectional areas generally are not equal to primary feed line cross-sectional areas, they are generally adequate for the relatively short travel distance —time required for the piston to move clear of the cushioned area. The flow volume and heat dissipation characteristics here are improved by the piston's circumferential "corrugated surface" and auxiliary circumferential flow grooves per my U.S. Patent application Ser. No. 893,284, referred to above.

Figure 2:
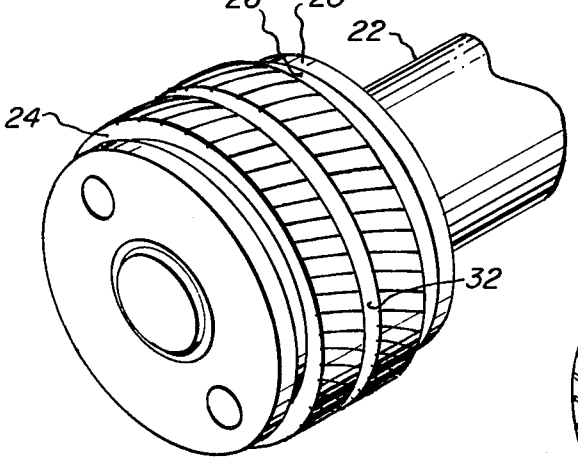
FIG. 2 is an isometric view of an alternative embodiment of piston construction.

In any case, a conservatively bore-clearanced piston with 0.001 inch clearance per inch of diameter will by-pass fluid volume at least equal to its usual inputting line volume at a normal system 2,000 p.s.i. pressure, though at an obviously higher fluid velocity. A 5 inch diameter piston with 0.005 inch piston-bore clearance shows a clearance cross-sectional area of 0.039 square inches ($in^2$), which will comfortably accommodate a typical diameter input line flow for that size cylinder, over the relatively short out of cushion distances. The example piston-bore clearance cross-sectional area is further increased by cylinder bore expansion by whatever pressure results from beginning load and fluid flow resistance. Given a normal C-1020 steel tube of ⅜ inch cylinder wall thickness, the 5 inch piston-bore clearance indicated would increase by approximately 50% if 2,000 pounds per square inch (p.s.i.) is reached, and said effective clearance cross-sectional area flow would virtually double if the above-referred to corrugated piston surface-auxiliary groove treatment is used, the latter also eliminating the local orifice-piston blocked junction restriction problem by conversion of point tangential to piston circumferential flow. Normal piston-bore clearances are sufficient to allow adequate out of cushion or input flow from the piston blocked orifice to the subject piston ring and on to the dash-pot area, particularly with a little suggested help at the local piston blocked orifice junction, per the referred to U.S. Patent Application Ser. No. 893,284. FIG. 2 shows a piston construction as described in my earlier patent application which may be used to good advantage in combination with the present invention.

Regarding the invention ring surface flow pattern itself and its by-pass flow cross-sectional area:

1. Other than that the interrupted face surfaces making contact with the ring groove wall be parallel with the opposite ring face, for obvious alignment purposes, there is no suggested or required surface pattern, except that it should be multiple, non-sharp corner notch-interruptions of the circumferential side face of the ring to minimize any local heat generation and minimize a lesser number of greater individual interruption depths which would unduly subtract from the minimum cross-sectional width (strength) of the ring. A regular circumferential pattern of small depth notches is preferable to a lesser number of deeper, more localized ones, said notches being accomplished by any variety of means, i.e. casting, forming, machining, etc.

2. Total cross-sectional flow by-pass capability should exceed the maximum probable flow exposure to the ring with the piston in the maximum orifice overlapped position, the assumption being that piston-orifice blocked flow has been diffused-translated to piston circumferential flow, the ring flow exposure will be that provided by the circumferential piston-bore clearance at its assumed high clearance tolerances.

Using the previous 5 inch bore cylinder as an example, the 0.039 $in^2$ clearance cross-sectional area could be realistically doubled as a ring flow base. Therefore, $(0.039) \times (2) = 0.078\ in^2$, which should be an adequate ring surface flow cross-section, the rough equivalent of a 5/16 inch diameter orifice capable of delivering approximately double the average primary line flow to a typical 5 inch bore cylinder, this considering the ring flow p.s.i. of 1,000 p.s.i. or half the average system pressure. Standard ring groove specifications are preferred for simplicity and conventional ring interchange purposes. Typical ring I.D. —groove bottom clearances are also adequate (radial 1/64 inch to 1/32 inch), but typical lateral ring-groove clearance can be too narrow at 0.001 inch minimums and should be not less than 0.005 inch to avoid ring edge flow choke or unnecessary flow restriction. This can be accommodated in a slightly reduced ring width, and lateral clearance should be 0.005–0.010 inch. Aside from other design reasons not related to the present invention, the ring groove land between the ring and the leading face of the piston should be approximately 0.030–0.060 inch smaller in diameter than the piston proper so as not to interfere with the ring's orifice closing and by-pass function.

The foregoing described use of a conventional metallic or rigid cross-section ring as a flow metering device utilizes the characteristic ring weepage to throttle fluid exhaust flow, thereby decellerating piston velocity and dampening piston bottoming impact. This does not preclude the possibility of a "limited" notch pattern in the otherwise "sealing" face of the ring if such additional cushion flow or lesser decelleration might be desirable. The inventive "opposite" face purpose is however: maximum possible flow for a maximum self canceling effect, which would make it largely useless in a ring reversed-installed position in the piston groove. The simple objective of the invention was to create a flow metering check valve effect between two piston circumferentially mounted piston seals by creation of a free flow surface in one of them. The subject ring therefore must be installed in its housing groove so that the ring notched surface is nearest the near piston vertical face or away from the inboard "bi-directional" seal; this being critical to use of the subject invention ring in combination with a separate, piston ring groove mounted, bi-directional sealing piston ring to accomplish the said flow metering check valve effect between two seals in a hydraulic cylinder piston, to severely restrict fluid exhaust flow near the end of one piston stroke then uniquely offering minimal restriction to input fluid flow in the opposite piston direction, from the terminal piston position, for maximum instant reverse stroke full velocity response.

FIG. 1 illustrates a hydraulic cylinder 10 and piston 20 in its fully retracted position. The cylinder and piston rod 22 have typical attachment lugs 12 and 16 for attachment to the mechanism actuated by the cylinder, lug 12 being adequately secured to its adjacent cylinder end plate which in turn is perhaps welded to the cylinder casing. Lug 16 is also secured to rod 22 which is shown threadably attached to piston 20 which, of course, is the driving member of the cylinder. A typical cylinder head 14 or cylinder end end plate, provides a sliding bearing journal for rod 22 and is fitted with adequate sealing members to prevent foreign material entry into the cylinder through the rod journal and to prevent oil leakage out of the cylinder. Ports (orifices) 15 and 17 illustrate the typical side wall ports referred to in the previous discussion, with 15 supplying extend stroke fluid (for piston direction 36) and providing retract stroke exhaust (for piston direction 34). Port 17 obviously is the retract stroke fluid input and extension stroke exhaust. Since the described orifice closing —cushion action and the inventive improvement "fast out of cushion" may be effected at either or both ends of the piston 20 stroke, for the sake of brevity, the following will concern fluid flow action near the piston "bottomed" position indicated in FIG. 1, 4A and 4B. Suffice it here to say the described action can be affected to accomplish extension stroke cushioning —invention fast reverse stroke response in the proximity of port 17 by merely installing the inventive surface of ring 25 in ring groove 26 with its notched face closest to the cylinder head 14. FIG. 1 indicates a piston 20 with a recommended 3-seal ring configuration in its circumferential surface. To accomplish the subject side wall cushion —fast reverse stroke response purpose, a rigid cross-section ring such as 25 is placed near either end of the piston with a centrally located bi-directional sealing ring as indicated by 32. It is obvious that the presence of a cushion action or the length of cushioned stroke portion is dependent on the placement of ports 15 and 17 ranging from nil or nothing if located immediately adjacent the left and right end plates, to maximum cushion length if located at a point near the central seal 32, when the piston is in its terminal position, as in FIG. 1.

FIG. 2 shows, as described earlier, an isometric view of my corrugated piston surface design, described in U.S. Pat. No. 4,086,844, which design may be combined with the present invention to further enhance the advantages described herein.

Figure 3:
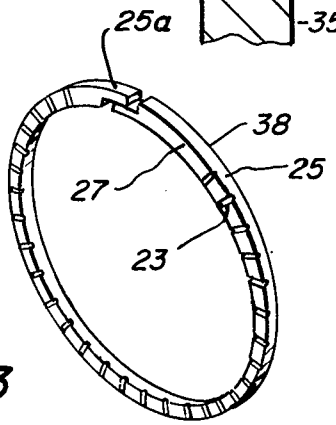
FIG. 3 is an isometric view of the piston ring of the present invention.

FIG. 3 shows a typical lap-jointed hydraulic piston ring 25 with its lapped expansion joint 25*a*. It also shows the surface pattern of notches 23 in ring face 27, which ring is installed in groove 24 and/or groove 26 with the notch pattern facing the closest piston end.

Figure 4B:
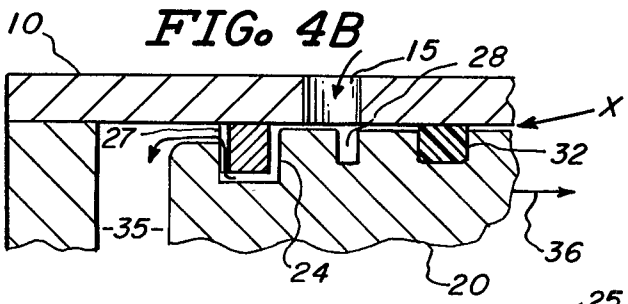
FIG. 4B is an expanded view of the piston and cylinder in a second relative position.
Figure 4A:
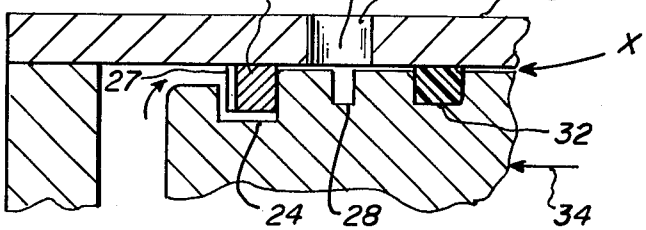
FIG. 4A is an expanded cross-section of the piston and cylinder in a first relative position.

The letter "X" of FIGS. 4A and 4B represents the shown piston-bore clearance which provides the flow channel between the piston blocked orifice 15 or 17 to the subject ring 25, as previously explained, but due to likely local weld distortion at 15 and 17, possible cylinder bore ovality and cylinder side loading, clearance "X" may be nil in the immediate area of 15 or 17 with the flow capacity of "X" being normally related to mean average piston-bore circumferential clearance. Flow grooves 28 and 30 are shown not as a part of the invention but as a preferred design inclusion to provide a more positive flow connection (in piston direction 34 or 36) between orifices 15 and 17 and the circumferential piston-bore clearance, when the piston is in the area of its terminal position as in FIGS. 1, 4A and 4B, or at the opposite stroke end near orifice 17. As indicated in FIG. 4A, in piston direction 34, ring 25 has passed port 15, and ring 25 has been forced against its rightward ring groove wall, by exhausting fluid, with ring 25 and its O.D. ring surface allowing a combined surface metered exhaust flow through "X" and flow groove 28 to port 15, the cushion action is provided.

FIG. 4B illustrates the fluid flow pattern and ring 25 position in groove 24 when the cylinder is valved for input flow to port 15 in the extension stroke of the cylinder. Ring face 27 moves against the leftward wall of groove 24 with its pattern of notches 23 providing the necessary final fluid flow connection from port 15 to the piston dash-pot area 35, for instant full reverse stroke or out of cushion piston velocity, even though port 15 is overlapped by piston 20 and ring 25. This is accomplished without resort to typical prior art secondary or separate out of cushion "stroke starter" circuits.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An improvement in hydraulic cylinder and piston and piston ring construction, including a cylinder having respective oil ports in a side wall proximate the cylinder ends and a piston having a plurality of piston rings, wherein the improvement comprises:

(a) a pair of piston ring grooves in said piston, each of said grooves having a predetermined width and substantially vertical side walls, said grooves located on said piston such that at least one of said side walls in a groove is between a respective oil port and cylinder end when said piston is at a respective extreme stroke position; and (b) a piston ring in each of said grooves, said ring having a width narrower than said groove width and having respective edge faces facing said groove side walls, the edge face facing the groove side wall closest to said cylinder end having a plurality of oil flow channels crossing said edge face.

2. The improvement of claim 1 wherein said plurality of oil flow channels are radially directed relative to the diameter of said piston ring.

3. An improvement in a hydraulic piston and cylinder combination of the type having a hydraulic oil port in the cylinder wall proximate an end of the cylinder and which port is blocked by the piston during at least a portion of the stroke, comprising (a) a first circumferential ring groove in said piston proximate a first end of said piston; said ring groove having substantially vertical side walls;

(b) a piston ring sized for fitting into said first circumferential ring groove, said ring having a width narrower than said groove and having respective edge faces facing said ring groove side walls, and having a plurality of flow channels cut across the edge face closest to said piston first end.

4. The apparatus of claim 3, further comprising a second circumferential ring groove proximate a second end of said piston, said second ring groove having substantially vertical side walls, and a second piston ring sized for fitting into said second groove, said second ring having respective edge faces facing said ring groove side walls and having a plurality of flow channels cut across the edge face closest to said piston second end.

5. The apparatus of claim 3, further comprising a further circumferential groove in said piston and a bi-directional sealing ring in said further circumferential groove.

6. The apparatus of claim 5, wherein said bi-directional sealing ring further comprises a deformable resilient sealing member.

7. The apparatus of claim 4, further comprising a third circumferential groove in said piston intermediate said first and second grooves, said third groove having therein a bi-directional sealing ring.

8. The apparatus of claim 7, wherein said bi-directional sealing ring further comprises a deformable resilient sealing member.

9. The apparatus of claim 7, further comprising fourth and fifth circumferential grooves in said piston respectively placed so that each is aligned with a hydraulic oil port when said piston is positioned at its respective extreme stroke positions.

10. The apparatus of claim 7, further comprising a further plurality of grooves in the surface of said piston, said further plurality of grooves providing oil flow communication between said circumferential grooves.

11. An improvement in a hydraulic cylinder and piston combination, comprising (a) a cylinder having a closed first end and having an oil port opening proximate said first end, and having a second end adapted for slidably accepting a piston rod and having an oil port opening proximate said second end;

(b) a piston slidably fitted in said cylinder and attached to a piston rod projecting through said cylinder second end;

(c) at least one circumferential groove around said piston having therein a sealing member;

(d) a second circumferential groove around said piston, between said sealing member and said cylinder first end, and between said oil port proximate said first cylinder end and said first cylinder end when said piston is at a first stroke end position, said second circumferential groove having therein a metallic ring for contacting said cylinder, said ring having a plurality of flow channels cut across an edge facing said cylinder first end; and (e) a third circumferential groove around said piston, between said sealing member and said cylinder second end, and between said oil port proximate said second cylinder end and said second cylinder end when said piston is at a second stroke end position, said third circumferential groove having therein a metallic ring for contacting said cylinder, said ring having a plurality of flow channels cut across an edge facing said cylinder end.

12. The apparatus of claim 11, wherein said second and third circumferential grooves are respectively sized to permit limited axial movement of said rings in said grooves.

13. The apparatus of claim 12, further comprising fourth and fifth circumferential grooves in said piston respectively positioned between said sealing member groove and said second groove, and between said sealing member groove and said third groove.

14. The apparatus of claim 11, further comprising a plurality of further grooves in the surface of said piston, said grooves providing oil flow communication between said second circumferential groove and said sealing member groove, and between said third circumferential groove and said sealing member groove.

* * * * *